US008778173B2

(12) United States Patent
Raterman et al.

(10) Patent No.: US 8,778,173 B2
(45) Date of Patent: Jul. 15, 2014

(54) PROCESS FOR PRODUCING A HIGH STABILITY DESULFURIZED HEAVY OILS STREAM

(75) Inventors: Michael F. Raterman, Doylestown, PA (US); Daniel P. Leta, Flemington, NJ (US); Walter D. Vann, Nazareth, PA (US); Roby Bearden, Jr., Baton Rouge, LA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 425 days.

(21) Appl. No.: 12/590,157

(22) Filed: Nov. 3, 2009

(65) Prior Publication Data

US 2010/0155298 A1 Jun. 24, 2010

Related U.S. Application Data

(60) Provisional application No. 61/203,048, filed on Dec. 18, 2008.

(51) Int. Cl.
*C10G 19/00* (2006.01)
*C07C 7/20* (2006.01)
*C07C 7/00* (2006.01)

(52) U.S. Cl.
USPC ..... 208/226; 208/49; 208/208 R; 208/39; 208/45; 208/309; 585/800; 585/833; 585/854

(58) Field of Classification Search
CPC ..... C10G 19/00; C10G 29/04; C10G 29/06; C10G 29/16; C10G 53/02; C10G 53/12
USPC ..... 208/226, 39, 45, 208 R, 309, 49; 585/800, 833, 853, 854
See application file for complete search history.

(56) References Cited

U.S. PATENT DOCUMENTS 2,360,272 A 10/1944 Plummer
3,051,645 A 8/1962 Wilson et al.

(Continued)

FOREIGN PATENT DOCUMENTS

GB 1133695 11/1968
GB 2067173 7/1981

OTHER PUBLICATIONS

Robert A. Meyers(ed.), Handbook of Petroleum Refining Processes, 2003, McGraw-Hill, 3d Edition, pp. 12.12-12.13.*

(Continued)

*Primary Examiner* — Walter D Griffin
*Assistant Examiner* — Derek Mueller
(74) *Attorney, Agent, or Firm* — Bruce M. Bordelon; Chad A. Guice

(57) ABSTRACT

The present invention relates to a process for desulfurizing heavy oil feedstreams with alkali metal compounds and improving the compatibility of the to stream components in either the feed stream, an intermediate product stream, and/or the reaction product stream in the desulfurization process. The present invention utilizes a high stability aromatic-containing stream that is preferably added to the heavy oil prior to reaction with the alkali metal compounds. The resulting stream resists precipitation of reaction solids in the desulfurization reactors. Even more preferably, the desulfurization system employs at least two desulfurization reactors in series flow wherein the high stability aromatic-containing stream is contacted with the reaction product from the first reactor prior to the second reactor, wherein the first reactor can be operated at a higher severity than without the use of the high stability aromatic-containing component stream.

21 Claims, 2 Drawing Sheets

(56) References Cited

U.S. PATENT DOCUMENTS

| | | | |
|---|---|---|---|
| 3,104,157 | A | 9/1963 | Kimberlin, Jr. et al. |
| 3,136,714 | A | 6/1964 | Gibson et al. |
| 3,164,545 | A | 1/1965 | Mattox |
| 3,354,081 | A | 11/1967 | Aldridge |
| 3,383,304 | A | 5/1968 | Mattox et al. |
| 3,387,941 | A | 6/1968 | Murphy et al. |
| 3,442,797 | A | 5/1969 | Aldridge |
| 3,449,242 | A | 6/1969 | Mattox et al. |
| 3,835,033 | A | 9/1974 | Dugan et al. |
| 3,847,797 | A | 11/1974 | Pasternak et al. |
| 3,850,742 | A | 11/1974 | Dugan et al. |
| 3,852,188 | A | 12/1974 | Dugan et al. |
| 3,873,670 | A | 3/1975 | Dugan et al. |
| 3,876,527 | A | 4/1975 | Dugan et al. |
| 4,003,823 | A | 1/1977 | Baird, Jr. et al. |
| 4,003,824 | A | 1/1977 | Baird, Jr. et al. |
| 4,007,109 | A | 2/1977 | Baird, Jr. et al. |
| 4,007,110 | A | 2/1977 | Bearden, Jr. |
| 4,007,111 | A | 2/1977 | Baird, Jr. |
| 4,087,348 | A | 5/1978 | Baird, Jr. et al. |
| 4,119,528 | A | 10/1978 | Baird, Jr. et al. |
| 4,127,470 | A | 11/1978 | Baird, Jr. et al. |
| 4,147,611 | A | 4/1979 | Miasek et al. |
| 4,147,612 | A | 4/1979 | Miasek et al. |
| 4,437,908 | A | 3/1984 | Inoue |
| 4,545,891 | A | 10/1985 | Meyers et al. |
| 4,566,965 | A | 1/1986 | Olmstead |
| 4,808,298 | A | 2/1989 | Peck et al. |
| 4,927,524 | A | 5/1990 | Rodriguez et al. |
| 5,059,307 | A | 10/1991 | Meyers et al. |
| 5,085,764 | A | 2/1992 | Meyers et al. |
| 5,508,018 | A | 4/1996 | Brons et al. |
| 5,626,742 | A | 5/1997 | Brons et al. |
| 5,635,056 | A | 6/1997 | Brons et al. |
| 5,695,632 | A | 12/1997 | Brons et al. |
| 5,871,637 | A | 2/1999 | Brons |
| 5,904,839 | A | 5/1999 | Brons |
| 5,935,421 | A | 8/1999 | Brons et al. |
| 5,997,723 | A | 12/1999 | Wiehe et al. |
| 2004/0069682 | A1 | 4/2004 | Freel et al. |
| 2004/0069686 | A1 | 4/2004 | Freel et al. |
| 2009/0152168 | A1 | 6/2009 | Siskin et al. |

OTHER PUBLICATIONS

Ana M Benito, et al., Visbreaking of an Asphaltenic Coal Residue, Fuel, vol. 74, No. 6, 1995, pp. 925-926.*

* cited by examiner

PROCESS FOR PRODUCING A HIGH STABILITY DESULFURIZED HEAVY OILS STREAM

This application claims the benefit of U.S. Provisional Application No. 61/203,048 filed Dec. 18, 2008.

FIELD OF THE INVENTION

The present invention relates to a process for desulfurizing heavy oil feedstreams with alkali metal compounds and improving the compatibility of the stream components in either the feed stream, an intermediate product stream, and/or the reaction product stream in the desulfurization process. These high compatibility feed, intermediate, and product streams have reduced incompatible asphaltene levels, thereby improving the overall reaction process, the reactor life, and quality of the final produced desulfurized heavy oil product stream.

DESCRIPTION OF RELATED ART

As the demand for hydrocarbon-based fuels has increased, the need for improved processes for desulfurizing heavy oil feedstreams has increased as well as the need for increasing the conversion of the heavy portions of these feedstreams into more valuable, lighter fuel products. These heavy oil feedstreams include, but are not limited to, whole and reduced petroleum crudes, shale oils, coal liquids, atmospheric and vacuum residua, asphaltenes, deasphalted oils, cycle oils, FCC tower bottoms, gas oils, including atmospheric and vacuum gas oils and coker gas oils, light to heavy distillates including raw virgin distillates, hydrocrackates, hydrotreated oils, dewaxed oils, slack waxes, raffinates, and mixtures thereof. Hydrocarbon streams boiling above 430° F. (220° C.) often contain a considerable amount of large multi-ring hydrocarbon molecules and/or a conglomerated association of large molecules containing a large portion of the sulfur, nitrogen and metals present in the hydrocarbon stream. A significant portion of the sulfur contained in these heavy oils is in the form of heteroatoms in polycyclic aromatic molecules, comprised of sulfur compounds such as dibenzothiophenes, from which the sulfur is difficult to remove.

The high molecular weight, large multi-ring aromatic hydrocarbon molecules or associated heteroatom-containing (e.g., S, N, O) multi-ring hydrocarbon molecules in heavy oils are generally found in a solubility class of molecules termed as asphaltenes. A significant portion of the sulfur is contained within the structure of these asphaltenes or lower molecular weight polar molecules termed as "polars" or "resins". Due to the large aromatic structures of the asphaltenes, the contained sulfur can be refractory in nature and can be difficult to remove.

These heavy oils typically contain significant amounts of sulfur. Sulfur contents of in excess of 2 to 5 wt % are not uncommon for these heavy oil streams and can often be concentrated to higher contents in the refinery heavy residual streams, such as atmospheric and vacuum gas oils. Additionally, most conventional catalytic refining and petrochemical processes cannot be used on these heavy feedstreams and intermediates due to their use of fixed bed catalyst systems and the tendency of these heavy hydrocarbons to produce excessive coking and deactivation of the catalyst systems when in contact with such feedstreams. Also, due to the excessive hydrocarbon unsaturation and cracking of carbon-to-carbon bonds experienced in these processes, significant amounts of hydrogen are required to treat high aromatic and asphaltene containing feeds. The high consumption of hydrogen, which is a very costly treating agent, in these processes results in significant costs associated with the conventional catalytic hydrotreating of heavy hydrocarbon feedstreams for sulfur removal.

One problem that exists in the industry is that heavy oil streams can be difficult to process even when utilizing an alkali metal salt treatment process due to the tendency of these asphaltene components of these heavy oils and their reaction products to precipitate during processing conditions thereby fouling the associated equipment and catalyst as well as requiring expensive and complicated facilities to handle and process the increased solids content in the reactor feed or intermediate process streams. This also leads to increased disposal costs for these hydrocarbon solids as well as a significant loss in alkali metal catalysts which can be bound to and removed with these hydrocarbon solids.

An additional problem exists in that many of these heavy oils, such as crudes, synthetic crudes, rough crude distillation cuts, and bitumens often need to be transported over pipelines spanning hundreds of miles for further processing at refineries and other related upgrading facilities. These pipelines have strict regulations on the solids content of the streams and therefore, the product stream to the pipeline must be low in solids as well as be stable such that the incompatible hydrocarbon compounds, in particular asphaltenes, in the product stream do not precipitate out of the stream during pipeline shipments as well as in the storage facilities associated with the pipeline transport.

Therefore, there exists in the industry a need for an improved process for improving the compatibility of the feed, intermediate, and/or product heavy oil streams associated with an alkali metal reagent desulfurization process.

SUMMARY OF THE INVENTION

The current invention embodies a process for improving the desulfurization of sulfur-containing heavy oils utilizing an alkali metal reagent. The process of the present invention improves the solubility of the components in the feed, intermediate, and/or product streams associated with the alkali metal desulfurization reaction process resulting in improved reaction efficiency, lower hydrocarbon product losses, lower solids disposal costs, lower alkali metal reagent losses and improved product stability.

A preferred embodiment of the present invention is a process for producing a stable desulfurized hydrocarbon product stream, comprising:

a) contacting a sulfur-containing heavy oils feedstream with an API gravity of less than about 20 with a first alkali metal reagent stream, and a first aromatic stability stream containing least 50 wt % aromatic hydrocarbons in a first reaction zone, thereby producing a desulfurized reaction stream comprised of desulfurized hydrocarbon compounds, spent alkali metal compounds, and hydrogen;

b) conducting the desulfurized reaction stream to a hydrocarbon product separator;

c) obtaining an aqueous spent alkali metal product stream from the hydrocarbon product separator; and d) obtaining a desulfurized hydrocarbon product stream from the hydrocarbon product separator;

wherein less than 3 wt % of the asphaltenes present in the heavy oil feedstream precipitate out in the first reaction zone, and the desulfurized hydrocarbon product stream has a sulfur content by wt % that is less than 40% of the sulfur content by wt % of the heavy oils feedstream.

In a preferred embodiment, at least two desulfurization reaction zones are utilized in the process described wherein a second alkali metal reagent stream and a second aromatic stability is contacted with the desulfurized reaction stream and is thereafter conducted to a second reaction zone prior to the hydrocarbon product separator.

In yet another preferred embodiment, less than 1 wt % of the asphaltenes present in the heavy oils feedstream precipitate out in the first reaction zone and the desulfurized reaction product stream has a sulfur content by wt % that is less than 25% of the sulfur content by wt % of the heavy oils feedstream.

DETAILED DESCRIPTION OF THE INVENTION

Figure 1:
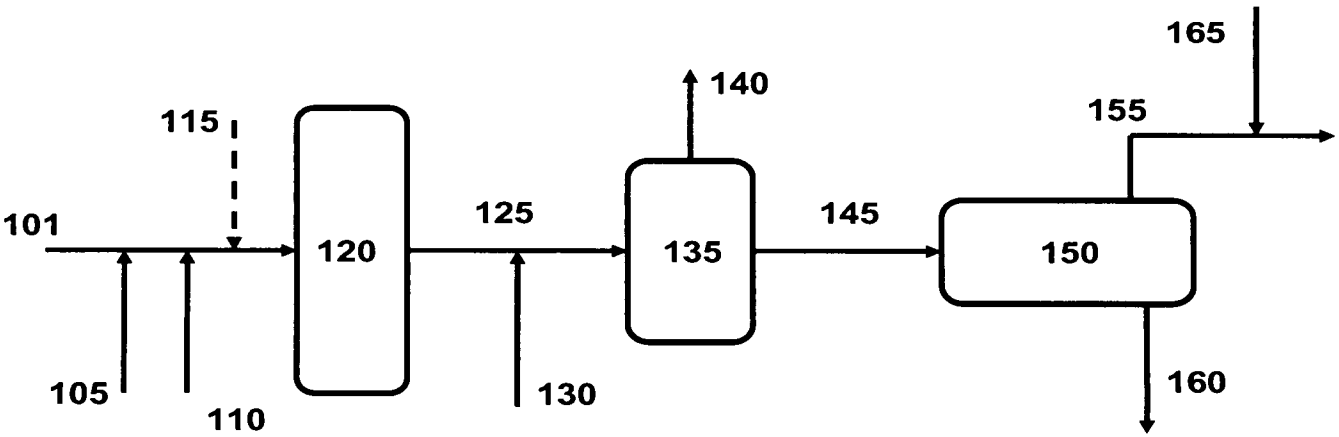
FIG. 1 illustrates one embodiment of the present invention wherein a sulfur-containing heavy oil feedstream is desulfurized utilizing an alkali metal reagent and a high aromatics stream in a single reactor desulfurization system to produce intermediate and final products with improved stability.

The present invention is a process for desulfurizing heavy oil feedstreams with alkali metal reagent compounds and improving the compatibility of the stream components in either the feed stream, an intermediate product stream, and/or the reaction product stream in the desulfurization process. These high compatibility feed, intermediate, and product streams have reduced incompatible asphaltene levels, thereby improving the overall reaction process, the reactor life, and quality of the final produced desulfurized heavy oil product stream.

The alkali metal reagents as utilized in the present invention for the desulfurization and demetallization of heavy oils streams are preferably selected from alkali metal hydroxides and alkali metal sulfides. The alkali metal hydroxides are preferably selected from potassium hydroxide, sodium hydroxide, rubidium hydroxide, cesium hydroxide, and mixtures thereof. The alkali metal sulfides are preferably selected from potassium sulfide, sodium sulfide, rubidium sulfide, cesium sulfide, and mixtures thereof. These alkali metal reagents are particularly useful in the desulfurization and demetallization of a heavy oil feedstream wherein a significant portion of asphaltenes may be present in the heavy oil stream. These hydrocarbon streams to be treated contain sulfur, much of which is part of the polar fraction and higher molecular weight aromatic and polycyclic heteroatom-containing compounds, herein generally referred to as "aphaltenes" or they are associated in the emulsion phase of such asphaltene species. "Asphaltenes" or the "asphaltene content" of a hydrocarbon stream as used herein are measured by ASTM D 6560-00 "Standard Test Method for Determination of Asphaltenes (Heptane Insolubles) in Crude Petroleum and Petroleum Products".

It should be noted here that the terms "heavy oil feedstream" or "heavy oil stream" as used herein are equivalent and are defined as any hydrocarbon-containing streams having an API gravity of less than 20. Preferred heavy oil feedstreams for use in the present invention include, but are not limited to low API gravity, high sulfur, high viscosity crudes; tar sands bitumen; liquid hydrocarbon streams derived from tar sands bitumen, coal, or oil shale; as well as petrochemical refinery heavy intermediate fractions, such as atmospheric resids, vacuum resids, and other similar intermediate feedstreams and mixtures thereof containing boiling point materials above about 650° F. (343° C.). Heavy oil feedstreams as described herein may also include a blend of the hydrocarbons listed above with lighter hydrocarbon streams, such as, but not limited to, distillates, kerosene, or light naphtha diluents, and/or synthetic crudes, for control of certain properties desired for the transport or sale of the resulting hydrocarbon blend, such as, but not limited to, transport or sale as fuel oils and crude blends. In preferred embodiments of the present invention, the heavy oil feedstream contains at least 60 wt % hydrocarbon compounds, and more preferably, the heavy oil feedstream contains at least 75 wt % hydrocarbon compounds.

In preferred embodiments of the present invention, the heavy oil feedstream that is desulfurized in the present process contains at least 1 wt % sulfur and more preferably at least 3 wt % sulfur. In other preferred embodiments of the present invention, the heavy oil feedstream that is desulfurized in the present process contains polycyclic sulfur heteroatom complexes which are difficult to desulfurize by conventional methods.

Embodiments of the present invention utilizes at least one aromatic stability stream as a stabilizer in the overall alkali metal hydroxide desulfurization process to improve the overall process performance and products as described above. As defined herein, the term "aromatic stability stream" is defined as a hydrocarbon-containing stream which contains at least 50 wt % of aromatic compounds based on the overall aromatic stability stream. The term "aromatic compounds" as utilized herein is defined as hydrocarbon compounds containing one or more unsaturated carbon rings.

Figure 2:
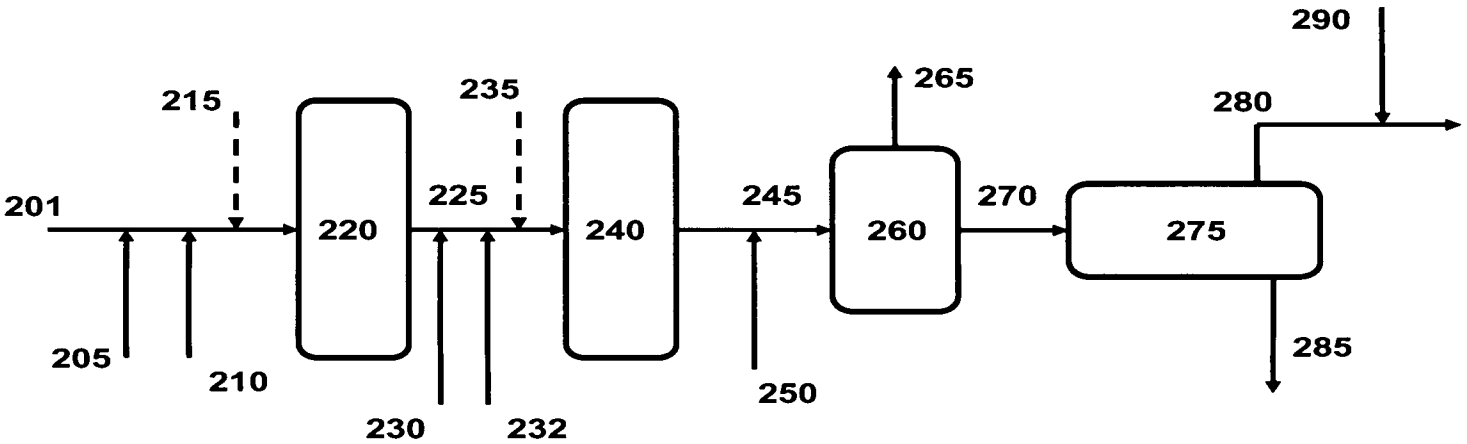
FIG. 2 illustrates one embodiment of the present invention wherein a sulfur-containing heavy oil feedstream is desulfurized utilizing an alkali metal reagent and a high aromatics stream in a multi-reactor desulfurization system to produce intermediate and final products with improved stability.

Embodiments of the present invention are best described by referring to the process diagrams as shown in FIGS. 1 and 2. FIG. 1 illustrates a preferred embodiment of the present invention wherein an alkali metal hydroxide treatment single reactor system is utilized. It should be noted that FIGS. 1 and 2 as presented herein are highly simplified flow diagrams of the process of the present invention, only illustrating the major processing equipment components and major process streams. It should be clear to one of skill in the art that additional equipment components and auxiliary streams may be utilized in the actual implementation of the invention as described.

Beginning with FIG. 1, a heavy oils feedstream (101) is mixed with an alkali metal reagent stream (105) and a pre-reaction aromatic stability stream (110). In a preferred embodiment, an additional hydrogen-containing stream (115) is also optionally added to the overall stream to the heavy oils desulfurization reactor (120). As shown, it is preferable that these streams are mixed prior to entering the heavy oils desulfurization reactor (120), but some or all of these streams may be fed directly to the heavy oils desulfurization reactor (120). Preferably, the alkali metal reagent stream (105) is comprised of a solution of water and an alkali metal hydroxide or an alkali metal sulfide. In a preferred embodiment, the alkali metal hydroxide is selected from the group consisting of potassium hydroxide, sodium hydroxide, rubidium hydroxide, cesium hydroxide, and mixtures thereof. In another preferred embodiment, the alkali metal sulfide is selected from the group consisting of potassium sulfide, sodium sulfide, rubidium sulfide, cesium sulfide, and mixtures thereof.

The aromatic stability streams utilized in the present invention preferably have an aromatics content of at least 50 wt % based on the total weight of the aromatic stability stream. More preferably, at least one of the aromatic stability streams utilized in the present invention preferably have an aromatics content of at least 60 wt %, and even more preferably at least 75 wt % based on the total weight of the aromatic stability stream. Preferred sources for the aromatic stability streams utilized in the present invention are high aromatic content product streams from a Fluid Catalytic Cracking Unit ("FCCU"), product streams from a pyrolysis unit, product streams from a visbreaking unit, or product streams from a coking unit. These process units and the products that are derived from these process units are well known in the art.

Even more preferred embodiments include wherein at least one of the aromatic stability streams is comprised of an FCCU product stream selected from a light catalytic cycle oil, a heavy catalytic cycle oil, and a catalytic bottoms oil. These stream terms are well known to those in the art, but for purposes of this application, a light catalytic cycle oil is a distillation stream obtained from an FCCU process wherein the hydrocarbon components of the stream boil substantially in the range of about 450° F. to about 650° F. (232° C. to 343° C.). A heavy catalytic cycle oil is a distillation stream obtained from an FCCU process wherein the hydrocarbon components of the stream boil substantially in the range of about 550° F. to about 750° F. (288° C. to 399° C.). A catalytic bottoms oil is a distillation stream obtained from an FCCU process wherein the hydrocarbon components of the stream boil substantially in the range of about 650° F.+ (343° C.+). The catalytic bottoms oil is a distillation stream obtained from the bottom of the distillation column from an FCCU and typically contains entrained catalyst particles, and therefore is also sometimes referred to as a "cat slurry oil". By the term "substantially", it is meant that at least 85 wt % of the overall hydrocarbon stream boils within the temperature range as designated under atmospheric pressure.

Additional preferred embodiments include wherein at least one of the aromatic stability streams is comprised of a visbreaking unit or coking unit distillation product stream selected from a naphtha distillation product stream, and gas oil distillation product stream, and a bottoms distillation product stream. These stream terms are well known to those in the art, but for purposes of this application, a naphtha distillation product stream is a distillation stream obtained from a visbreaking or coking process wherein the hydrocarbon components of the stream boil substantially in the range of about 450° F. to about 650° F. (232° C. to 343° C.). A gas oil distillation product stream is a distillation stream obtained from a visbreaking or coking process wherein the hydrocarbon components of the stream boil substantially in the range of about 550° F. to about 750° F. (288° C. to 399° C.). A bottoms distillation product stream is a distillation stream obtained from a visbreaking or coking process wherein the hydrocarbon components of the stream boil substantially in the range of about 650° F.+ (343° C.+).

Continuing with FIG. 1, if a hydrogen-containing stream is utilized as a feed to the desulfurization reactor, it is preferred that the hydrogen-containing stream (115) contain at least 50 mol %, more preferably at least 75 mol % hydrogen. When hydrogen is utilized in the process, it is preferred that the hydrogen partial pressure in the heavy oils desulfurization reactor (120) be from about 100 to about 2500 psi (689 to 17,237 kPa). At these partial pressures, the hydrogen assists in the reaction process by removing at least a portion of the sulfur in the hydrocarbons via conversion to the alkali metal hydrosulfide, which may, but is not required to, go through a hydrogen sulfide, $H_2S$ intermediate. Hydrogen sulfide that is formed in the first reaction zone can also react with the alkali metal hydroxides donating some of the sulfur and forming alkali metal hydrosulfides and alkali metal sulfides thereby improving the overall sulfur removal in the process. Excess hydrogen also assists in hydrogenating the broken sulfur bonds in the hydrocarbons and increasing the hydrogen saturation of the resulting desulfurized hydrocarbon compounds.

Herein, the desulfurization reactor (120) can be comprised of a vessel or even simply piping which provides sufficient time and conditions for the heavy stream, the aromatic stability stream, and the alkali metal hydroxide to contact sufficiently to allow for the hydrocarbon portion of the overall process stream to be desulfurized. In the present invention, the aromatic stability stream prevents significant asphaltene precipitation during the desulfurization reaction process, thereby improving the overall desulfurization process, reducing hydrocarbon losses, and reducing alkali metal compound losses as these alkali metal compounds tend to get bound to and removed with the precipitated asphaltene components of the heavy oil feedstream in conventional processing.

Following the process scheme of FIG. 1, a desulfurized reaction product stream (125) is removed from the heavy oils desulfurization reactor (120). This desulfurized reaction product stream (125) is comprised of desulfurized hydrocarbon compounds, spent (e.g., sulfurized) alkali metal compounds, and hydrogen. Preferred conditions in the heavy oils desulfurization reactor are from about 600° F. to about 900° F. (316° C. to 482° C.), preferably about 650° F. to about 875° F. (343° C. to 468° C.), and more preferably about 700° F. to about 850° F. (371° C. to 454° C.) and about 50 to about 3000 psi (345 to 20,684 kPa), preferably about 200 to about 2200 psi (1,379 to 15,168 kPa), and more preferably about 500 to about 1500 psi (3,447 to 10,342 kPa). Additionally, it is preferred that the contact time of the heavy oils feedstream, the pre-reaction aromatic stability stream, and the alkali metal hydroxide stream in the heavy oils desulfurization reactor be about 5 to about 720 minutes, preferably about 30 to about 480 minutes, and more preferably 60 to about 240 minutes, although the contact time is highly dependent upon the physical and chemical characteristics of the hydrocarbon stream including the sulfur content and sulfur species of the hydrocarbon stream, the amount of sulfur to be removed, as well as the molar ratio of the alkali metal reagent used in the process to the sulfur present in the heavy oils feedstream.

It is preferred that the amount of the pre-reaction aromatic stability stream (110) that is added in to the process is controlled to the point at which less than 3 wt % of the asphaltenes in the heavy oil feedstream precipitate out in the heavy oils desulfurization reactor (120). More preferably, the amount of the pre-reaction aromatic stability stream (110) that is added in to the process is controlled to the point at which less than 1 wt % of the asphaltenes in the heavy oil feedstream precipitate out in the heavy oils desulfurization reactor (120).

In some instances, the precipitation point to which one may want to control the pre-reaction aromatic stability stream (110) may not be at the conditions of the heavy oils desulfurization reactor (120). In some instances, the asphaltenes may be soluble under the heavy oils desulfurization reactor (120) conditions which typically run at temperatures of from about 600° F. to about 900° F. (316° C. to 482° C.). At higher temperatures, the asphaltenes tend to increase in stability and therefore a higher wt % of asphaltenes can be retained in a hydrocarbon stream without precipitating than at lower temperatures. Therefore, the amount of the pre-reaction aromatic stability stream (110) added to the present process may be controlled by the asphaltene precipitation rate at the lower storage or pipeline temperatures.

While the addition of the pre-reaction aromatic stability stream can be added at element (110), a post-reaction aromatic stability stream (130) can either be added to the process either alternatively or in addition to the pre-reaction aromatic stability stream (110). While the pre-reaction aromatic stability stream (110) assists in reducing fouling of the heavy oils desulfurization reactor (120) and improves the overall desulfurization performance, some or all of an aromatic stability stream can be added after the heavy oils desulfurization reactor as a post-reaction aromatic stability stream (130). In this instance, the post-reaction aromatic stability stream (130) assists in stabilizing the desulfurized reaction product stream (125) to prevent solids precipitation in downstream equipment particularly as the product stream is reduced in temperature. This has an additional benefit to the overall process by not reducing the capacity of the heavy oils desulfurization reactor (120) since this post-reaction aromatic stability stream is added after the reactor, thereby not displacing the heavy oil feed stream (101) to the heavy oils desulfurization reactor (120).

In the present invention, it is important that there is proper mixing and contact between the heavy oil feedstream (101), the alkali metal reagent stream (105), and the aromatic stability stream(s), especially when a pre-reaction aromatic stability stream (110) is utilized upstream of the heavy oils desulfurization reactor (120). Therefore in preferred embodiments, a slurry reactor or ebulating bed reactor design is preferred for use as the heavy oils desulfurization reactor (120). Additionally, static, rotary, or other types of mixing devices can be employed in the feed lines to heavy oils desulfurization reactor (120), and/or mixing devices can be employed in the heavy oils desulfurization reactor (120) to improve the contact between the heavy oil feedstream, the alkali metal reagent stream, and the pre-reaction aromatic stability stream.

After the desulfurized reaction product stream (125) is removed from the heavy oils desulfurization reactor (120), the desulfurized reaction product stream is preferably sent to a low pressure separator (135) wherein at least a portion of the of the hydrogen, light hydrocarbons, and non-condensable components of the desulfurized reaction product stream (125) can be removed via line (140). A degassed reaction stream (145) containing desulfurized hydrocarbons and spent alkali metal compounds is then sent to a hydrocarbon product separator (150) wherein the desulfurized hydrocarbons and spent alkali metal compounds are separated by various methods known in the art, e.g., a water wash. The spent alkali metal compounds tend to be more soluble in the water-based phase than the desulfurized hydrocarbon. As such, preferred methods of separation include gravitational (or density based) separations processes known in the art such as, but not limited to, the use of settling vessels, hydroclones, or centrifuges. In these processes, it is generally advantageous to keep the temperatures in the range of from 50° F. to about 300° F. (10° C. to 149° C.) in order to improve the contacting of the hydrocarbon with the water phase. A desulfurized hydrocarbon product stream (155) is thus obtained from the hydrocarbon product separator (150) and an aqueous spent alkali metal product stream (160) is also obtained. Filtering can also be utilized to remove some of the solids compounds formed, such as, but not limited to, coke and precipitated asphaltenes, as well as iron, vanadium, and nickel compounds derived from the heavy oils feedstream.

By the term "desulfurized hydrocarbon product stream" it is meant that the sulfur content by wt % of the desulfurized hydrocarbon product stream is less than 40% of the sulfur content by wt % of the heavy oils feedstream. In a more preferred embodiment of the present invention, the sulfur content by wt % of the desulfurized hydrocarbon product stream is less than 25% of the sulfur content by wt % of the heavy oils feedstream. In a most preferred embodiment of the present invention, the sulfur content by wt % of the desulfurized hydrocarbon product stream is less than 10% of the sulfur content by wt % of the heavy oils feedstream. These parameters are based on water-free hydrocarbon streams.

The present invention significantly improves the processes of the prior art by reducing the amount of precipitated solids in these intermediate and product to streams. However, as discussed prior, the asphaltene solids may precipitate out at the lower temperatures described herein for the hydrocarbon product separator (150) than for the higher temperatures found in the heavy oils desulfurization reactor (120). Therefore, in a preferred embodiment, the amount of either one or both of the aromatic stability streams (110 and/or 130) added to the overall reactor feedstream may be controlled such that a minimal amount of asphaltene precipitates in the hydrocarbon product separator (150). In a preferred embodiment, the amount of aromatic stability stream(s) (110 and/or 130) that is incorporated into the process is controlled to the point at which less than 3 wt % of the asphaltenes in the heavy oil feedstream (101) precipitate out in the hydrocarbon product separator (150). More preferably, the amount of aromatic stability stream(s) that is incorporated into the process is controlled to the point at which less than 1 wt % of the asphaltenes in the heavy oil feedstream (101) precipitate out in the hydrocarbon product separator (150).

It should also be noted that after separating the desulfurized hydrocarbon product stream (155), this product is typically further sent to storage tanks and then further to a pipeline. A problem that exists is that if the desulfurized hydrocarbon product stream being sent to the pipeline is not stable, asphaltenes can precipitate from the product stream into the pipeline thereby exceeding the maximum solids content specification for the pipeline. Therefore, the pipeline product control requirements may be such that they are the ultimate control limit for the amount of aromatic stability stream(s) (110 and/or 130) that is added in to the process. In a preferred embodiment of the present invention, the amount of aromatic stability stream(s) that is added in to the process is controlled to the point wherein the portion of the desulfurized hydrocarbon product stream (155) that is sent to a pipeline has a solids content lower than the allowable solids content specification for the pipeline.

In another embodiment of the present invention, an additional aromatic stability stream (165) may be, added to the desulfurized hydrocarbon product stream (155) to improve the stability of the resulting blended product stream. Preferably, the amount of the aromatic stability stream (165) is controlled to the point wherein the portion of the desulfurized hydrocarbon product stream (155) that is sent to a pipeline has a solids content lower than the allowable solids content specification for the pipeline. In another preferred embodiment, the aromatic stability stream (165) is added to the desulfurized hydrocarbon product stream (155) in an amount wherein less than 3 wt % of the asphaltenes in the heavy oil feedstream precipitate out in the downstream storage associated with a transportation pipeline. More preferably, the amount of the aromatic stability stream (165) is added to the desulfurized hydrocarbon product stream (155) to wherein less than 1 wt % of the asphaltenes in the heavy oil feedstream precipitate out in the downstream storage associated with a transportation pipeline.

It should also be noted that a preferred embodiment of the present invention can be utilized with a similar sulfur reduction process utilizing multiple desulfurization reactors than just a single desulfurization reactor as shown in FIG. 1.

FIG. 2 illustrates an embodiment of the present invention utilizing a two reactor stage process flow scheme, wherein the reactors are in series flow with the heavy oils feedstream to be desulfurized. The two (or multi-stage) desulfurization reactor embodiments of the process of the present invention as illustrated in FIG. 2 can be beneficial in many ways. Firstly, as will be shown below, multiple aromatic stability streams can be injected at points prior and after the reactors, as illustrated in the embodiment of FIG. 1, but in the embodiment of FIG. 2, an intermediate aromatic stability stream can be injected between the desulfurization reactors. This allows for the first desulfurization reactor to be run at a severity to wherein the asphaltenes in the product stream are near the point of incompatibility and at the point of precipitation. The intermediate aromatic stability stream is then introduced prior to the second reactor to prevent precipitation from occurring during reactions in the second desulfurization reactor. This allows the overall process to be run at a higher desulfurization severity than if there were only a single reactor. Additional benefits of a two (or multi-) reactor desulfurization system include, higher overall heavy oil feed throughput due to lower amount or elimination of the pre-reaction aromatic stability stream, smaller size desulfurization reactors with better contact of the overall reaction mixture, as well as better heat control and hydrogenation control.

Therefore, FIG. 2 illustrates an embodiment of the present invention utilizing two desulfurization reactors, which operation is briefly described as follows. It should be noted that it is within the ability of one of ordinary skill in the art with the knowledge of the present invention to expand the embodiments as shown in FIGS. 1 and 2 to cover embodiments with more than two desulfurization reactors and/or embodiments using multiple desulfurization reactors in a parallel flow processing scheme. For the sake of brevity, unless otherwise noted in the description of FIG. 2 below, the reaction conditions; the feedstream, intermediate streams, and product streams properties; as well as the precipitation control targets are the same as those noted for the single reactor embodiment as described prior for the embodiment illustrated in FIG. 1.

In the multi-reactor embodiment shown in FIG. 2, a heavy oil feed stream (201) is mixed with a first alkali metal reagent stream (205) and a pre-reaction aromatic stability stream (210). In a preferred embodiment, an additional first hydrogen-containing stream (215) is also optionally added to the overall stream to the first heavy oils desulfurization reactor (220). As shown, it is preferable that these streams are mixed prior to entering the first heavy oils desulfurization reactor (220), but some or all of these streams may be fed directly to the first heavy oils desulfurization reactor (220). Preferably, the alkali metal reagent stream(s) of this embodiment are comprised of a solution of water and an alkali metal hydroxide or an alkali metal sulfide. In a preferred embodiment, the alkali metal hydroxide is selected from the group consisting of potassium hydroxide, sodium hydroxide, rubidium hydroxide, cesium hydroxide, and mixtures thereof. In another preferred embodiment, the alkali metal sulfide is selected from the group consisting of potassium sulfide, sodium sulfide, rubidium sulfide, cesium sulfide, and mixtures thereof. Unless otherwise noted, the aromatic stability streams utilized in the embodiment of the present invention illustrated in FIG. 2 are the same in composition as those described for the embodiment of FIG. 1.

Following the process scheme of FIG. 2, an intermediate desulfurized reaction product stream (225) is removed from the first heavy oils desulfurization reactor (220) and a second alkali metal reagent stream (232) is added to the intermediate desulfurized reaction product stream (225). In this embodiment of the present invention, an intermediate aromatic stability stream (230) is preferably injected into the intermediate desulfurized reaction product stream (225). Due the two (multi-) reactor configuration as shown in FIG. 2, the amount of the pre-reaction aromatic stability stream (210) necessary for proper operation necessary to reduce the amount of precipitated solids can be significantly reduced or even eliminated. Here, it is preferred that the amount of intermediate aromatic stability stream (230) introduced into the process is controlled to the point at which less than 3 wt % of the asphaltenes in the heavy oil feedstream (201) precipitate out in the second heavy oils desulfurization reactor (240). More preferably, the amount of aromatic stability stream(s) that is incorporated into the process is controlled to the point at which less than 1 wt % of the asphaltenes in the heavy oil feedstream (201) precipitate out in the second heavy oils desulfurization reactor (240). Additionally, as shown in FIG. 2, a second hydrogen-containing stream (235) may be optionally added to the intermediate desulfurized reaction product stream (225) prior to the second heavy oils desulfurization reactor (240).

A final desulfurized reaction product stream (245) is comprised of desulfurized hydrocarbon compounds, spent (e.g., sulfurized) alkali metal compounds, and hydrogen is removed from the second heavy oils desulfurization reactor (240). If desired, a post-reaction aromatic stability stream (250) can be added to the final desulfurized reaction product stream (245) to improve its stability. The final desulfurized reaction product stream (245) is preferably sent to a low pressure separator (260) wherein at least a portion of the hydrogen, light hydrocarbons, and non-condensable components of the final desulfurized reaction product stream (245) can be removed via line (265). A degassed reaction stream (270) containing desulfurized hydrocarbons and spent alkali metal compounds are then sent to a hydrocarbon product separator (275) wherein the desulfurized hydrocarbons and spent alkali metal compounds are separated by various methods known in the art, e.g., a water wash. Similar processes and conditions as described for the hydrocarbon product separator in the embodiment of FIG. 1 can also be utilized here. A desulfurized hydrocarbon product stream (280) is obtained from the hydrocarbon product separator (275) and an aqueous spent alkali metal product stream (285) is also obtained. Filtering can also be utilized to remove some of the solids compounds formed, such as, but not limited to, coke and precipitated asphaltenes, as well as iron, vanadium, and nickel compounds derived from the heavy oils feedstream.

In another embodiment of the present invention, a product aromatic stability stream (290) may be added to the desulfurized hydrocarbon product stream (280) to improve the stability of the resulting blended product stream. Preferably, the amount of the product aromatic stability stream (290) is controlled to the point wherein the portion of the desulfurized hydrocarbon product stream (280) that is sent to a pipeline has a solids content lower than the allowable solids content specification for the pipeline. In another preferred embodiment, the product aromatic stability stream (290) is added to the desulfurized hydrocarbon product stream (280) in an amount wherein less than 3 wt % of the asphaltenes in the heavy oil feedstream precipitate out in the downstream storage associated with a transportation pipeline. More preferably, the amount of the product aromatic stability stream (290) added to the desulfurized hydrocarbon product stream (280) to wherein less than 1 wt % of the asphaltenes in the heavy oil feedstream precipitate out in the downstream storage associated with a transportation pipeline.

Similar to the single reactor process as embodied in FIG. 1, in the multi-reactor process of FIG. 2, the term "desulfurized hydrocarbon product stream" it is meant that the sulfur content by wt % of the desulfurized hydrocarbon product stream is less than 40% of the sulfur content by wt % of the heavy oils feedstream. In a more preferred embodiment of the present invention, the sulfur content by wt % of the desulfurized hydrocarbon product stream is less than 25% of the sulfur content by wt % of the heavy oils feedstream. In a most preferred embodiment of the present invention, the sulfur content by wt % of the desulfurized hydrocarbon product stream is less than 10% of the sulfur content by wt % of the heavy oils feedstream. These parameters are based on water-free hydrocarbon streams.

Although the present invention has been described in terms of specific embodiments, it is not so limited. Suitable alterations and modifications for operation under specific conditions will be apparent to those skilled in the art. It is therefore intended that the following claims be interpreted as covering all such alterations and modifications as fall within the true spirit and scope of the invention.

What is claimed is:

1. A process for producing a stable desulfurized hydrocarbon product stream, comprising:

a) contacting a sulfur-containing heavy oils feedstream with an API gravity of less than about 20 with a first alkali metal reagent stream, and a first aromatic stability stream containing at least 50 wt % aromatic hydrocarbons in a first reaction zone, thereby producing a desulfurized reaction stream comprised of desulfurized hydrocarbon compounds, spent alkali metal compounds, and hydrogen;

b) conducting the desulfurized reaction stream to a hydrocarbon product separator;

c) obtaining an aqueous spent alkali metal product stream from the hydrocarbon product separator;

d) filtering the aqueous spent alkali metal product stream to remove coke, precipitated asphaltenes, iron, vanadium and nickel from the spent alkali metal product stream; and e) obtaining a desulfurized hydrocarbon product ream from the hydrocarbon product separator;

wherein less than 3 wt % of the asphaltenes present in the heavy oil feedstream precipitate out in the first reaction zone, and the desulfurized hydrocarbon product stream has a sulfur content by wt % that is less than 40% of the sulfur content by wt % of the heavy oils feedstream, and wherein the first aromatic stability stream comprises a light catalytic cycle oil, a heavy catalytic cycle oil, or a catalytic bottoms oil from a Fluid Catalytic Cracking Unit (FCCU).

2. The process of claim 1, wherein the alkali metal reagent stream is comprised of an alkali metal hydroxide selected from potassium hydroxide, sodium hydroxide, rubidium hydroxide, cesium hydroxide, and mixtures thereof.

3. The process of claim 1, wherein the alkali metal reagent stream is comprised of an alkali metal sulfide selected from potassium sulfide, sodium sulfide, rubidium sulfide, cesium sulfide, and mixtures thereof.

4. The process of claim 1, wherein the heavy oils feedstream has a sulfur content of at least 3 wt %.

5. The process of claim 1, wherein the reaction conditions in the first reaction zone are from about 50 to about 3000 psi (345 to 20,684 kPa), and from about 600° F. to about 900° F. (316° C. to 482° C.).

6. The process of claim 5, wherein a first hydrogen-containing stream comprising at least 50 mol % hydrogen is conducted to the first reaction zone.

7. The process of claim 1, wherein the first aromatic stability stream contains at least 65 wt % aromatic hydrocarbons.

8. The process of claim 1, wherein the contact time of the heavy oils feedstream, the first aromatic stability stream, and the first alkali metal hydroxide stream in the first reaction zone is from about 5 to about 720 minutes.

9. The process of claim 1, wherein the desulfurized reaction stream is contacted with a second aromatic stability stream containing least 50 wt % aromatic hydrocarbons prior to the hydrocarbon product separator.

10. The process of claim 9, wherein the combined desulfurized reaction stream and second aromatic stability stream is conducted to a second reaction zone prior to the hydrocarbon product separator.

11. The process of claim 1, wherein a second alkali metal reagent stream is contacted with the desulfurized reaction stream and is thereafter conducted to a second reaction zone prior to the hydrocarbon product separator.

12. The process of claim 11, wherein a second aromatic stability stream is contacted with the second alkali metal reagent stream and the desulfurized reaction stream prior to the second reaction zone.

13. The process of claim 11, wherein the second alkali metal reagent stream is comprised of an alkali metal hydroxide selected from potassium hydroxide, sodium hydroxide, rubidium hydroxide, cesium hydroxide, and mixtures thereof.

14. The process of claim 11, wherein the second alkali metal reagent stream is comprised of an alkali metal sulfide selected from potassium sulfide, sodium sulfide, rubidium sulfide, cesium sulfide, and mixtures thereof.

15. The process of claim 13, wherein the desulfurized hydrocarbon product stream has a sulfur content by wt % that is less than 25% of the sulfur content by wt % of the heavy oils feedstream.

16. The process of claim 15, wherein a second hydrogen-containing stream comprising at least 50 mold hydrogen is conducted to the second reaction zone.

17. The process of claim 1, wherein less than 1 wt % of the asphaltenes present in the heavy oils feedstream precipitate out in the first reaction zone and the desulfurized reaction product stream has a sulfur content by wt % that is less than 25% of the sulfur content by wt % of the heavy oils feedstream.

18. The process of claim 11, wherein less than 1 wt % of the asphaltenes present in the heavy oils feedstream precipitate out in the second reaction zone and the desulfurized hydrocarbon product stream has a sulfur content by wt % that is less than 25% of the sulfur content by wt % of the heavy oils feedstream.

19. The process of claim 18, wherein a second aromatic stability stream is contacted with the second alkali metal reagent stream and the desulfurized reaction stream.

20. The process of claim 1, wherein at least a portion of the desulfurized hydrocarbon product stream is sent through a transportation pipeline.

21. The process of claim 1, wherein less than 1 wt % of the asphaltenes present in the heavy oils feedstream precipitate out in the hydrocarbon product separator and the desulfurized hydrocarbon product stream has a sulfur content by wt % that is less than 25% of the sulfur content by wt % of the heavy oils feedstream.

* * * * *